US007389545B2

(12) United States Patent
Lin et al.

(10) Patent No.: US 7,389,545 B2
(45) Date of Patent: Jun. 24, 2008

(54) BASEBALL GLOVE HAVING A PALM SECTION PROVIDES WITH A CUSHION SHEET

(75) Inventors: Kuan-Ming Lin, Kaohsiung (TW); Tai-Ming Chung, Kaohsiung (TW)

(73) Assignee: Taiwan Sakura Mfg. Co., Ltd., Kaohsiung ( * ) Notice: Subject to any disclaimer, the term of this patent is extended or adjusted under 35 U.S.C. 154(b) by 0 days.

(21) Appl. No.: 11/639,654

(22) Filed: Dec. 14, 2006

(65) Prior Publication Data

US 2008/0060105 A1 Mar. 13, 2008

(30) Foreign Application Priority Data

Aug. 28, 2006 (TW) ..... 95215240 U

(51) Int. Cl.
*A63B 71/14* (2006.01)

(52) U.S. Cl. ..... 2/19; 2/163; 2/161.1

(58) Field of Classification Search ..... 2/19, 2/161.1, 163

See application file for complete search history.

(56) References Cited

U.S. PATENT DOCUMENTS

| | | | | |
|---|---|---|---|---|
| 5,075,899 | A * | 12/1991 | Funahashi et al. | 2/19 |
| 5,398,342 | A * | 3/1995 | Kinnee et al. | 2/19 |
| 6,748,600 | B1 * | 6/2004 | Motooka et al. | 2/19 |
| 2001/0025382 | A1 * | 10/2001 | Murai | 2/19 |
| 2005/0120453 | A1 * | 6/2005 | Wu | 2/19 |

* cited by examiner

*Primary Examiner*—Gary L. Welch
*Assistant Examiner*—Alissa J Tompkins
(74) *Attorney, Agent, or Firm*—Townsend and Townsend and Crew, LLP

(57) ABSTRACT

A baseball glove includes a palm side ply that has an inner face and a palm section, and a back side ply facing the inner face and connected to the palm side ply. A cushion sheet is attached to the inner face of the palm side ply, and has a palm portion substantially corresponding to the palm section, a plurality of finger portions extending upwardly from the palm portion, a plurality of webs each extending between two adjacent ones of the finger portions, a hill portion projecting from the palm portion, and a plurality of curved ribs each disposed along a respective one of the webs. The hill portion and the curved ribs have shock-absorbing foamed materials.

7 Claims, 10 Drawing Sheets

BASEBALL GLOVE HAVING A PALM SECTION PROVIDES WITH A CUSHION SHEET

CROSS-REFERENCE TO RELATED APPLICATION

This application claims priority of Taiwanese Application No. 095215240, filed on Aug. 28, 2006.

BACKGROUND OF THE INVENTION

1. Field of the Invention

The invention relates to a glove, more particularly to a baseball or softball glove.

2. Description of the Related Art

Referring to FIGS. 1 and 2, a conventional baseball glove 1 has a glove body 10 including a palm side ply 11 that has a ball-catching region 111, and a back side ply 12 connected to the palm side ply 11 and cooperating with the same to define a hand-receiving chamber. The hand-receiving chamber has an opening 13 for insertion of a player's hand therein, and finger sections 121 for insertion of the player's fingers therein.

A player frequently has to catch high-speed balls either thrown by a teammate or batted by a batter. Further, since a baseball is hard, the baseball glove 1 and the hand of the player must absorb a great impact force during catching of a ball, so that the player's fingers are easily injured.

SUMMARY OF THE INVENTION

Therefore, the object of the present invention is to provide a baseball glove that can buffer impact forces when catching a ball so as to protect a player's hand.

According to this invention, a baseball glove comprises a glove body and a cushion sheet. The glove body is composed of a palm side ply that has an inner face, and a back side ply facing the inner face and connected to the palm side ply. The glove body includes a palm section, and finger sections extending upwardly from the palm section. The cushion sheet is attached to the inner face of the palm side ply, and has a palm portion substantially corresponding to the palm section, a plurality of finger portions extending upwardly from the palm portion, a plurality of webs each extending between two adjacent ones of the finger portions, a hill portion projecting from the palm portion, and a plurality of curved ribs each disposed along a respective one of the webs. The hill portion and the curved ribs have shock-absorbing foamed materials.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
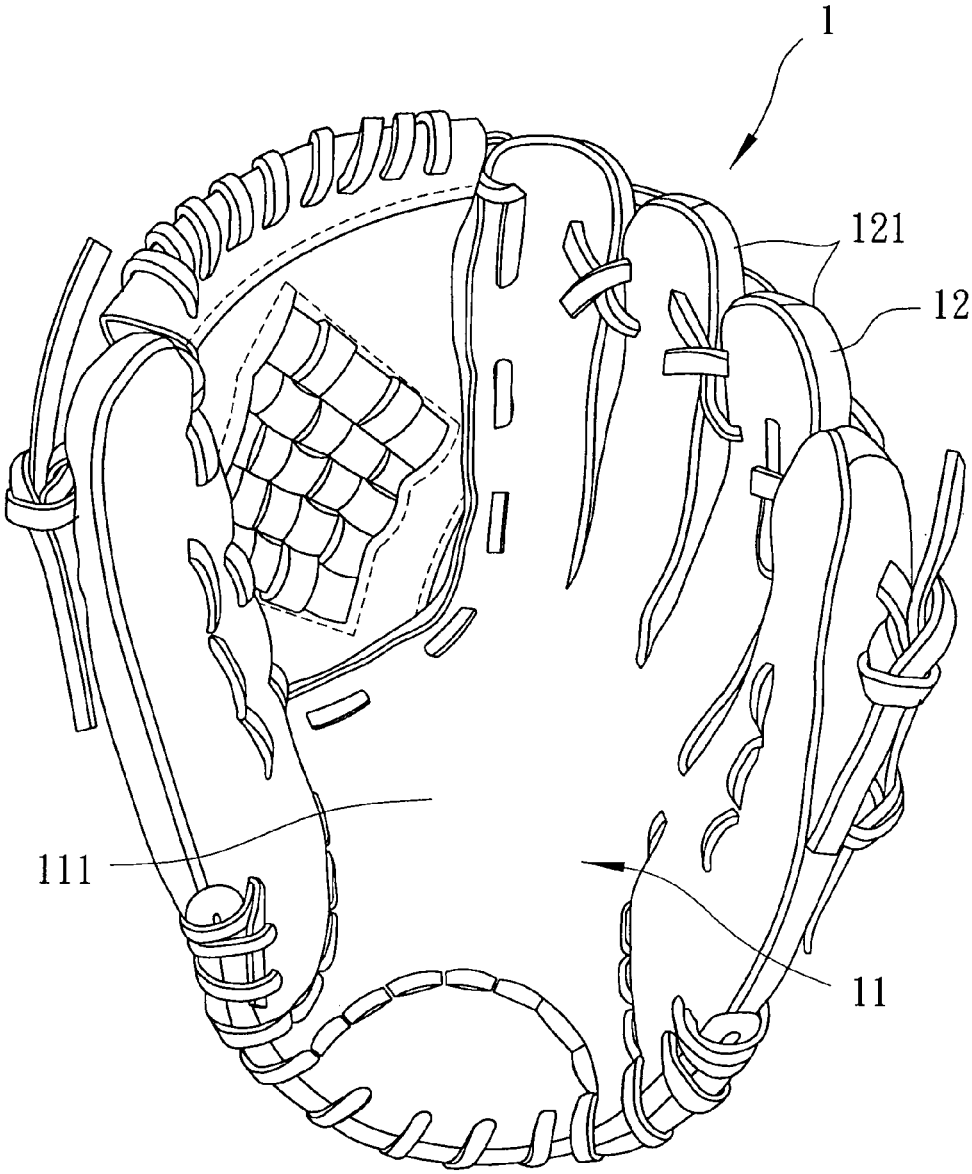
FIG. 1 PRIOR ART
FIG. 1 is a schematic front view of a conventional baseball glove.
Figure 2:
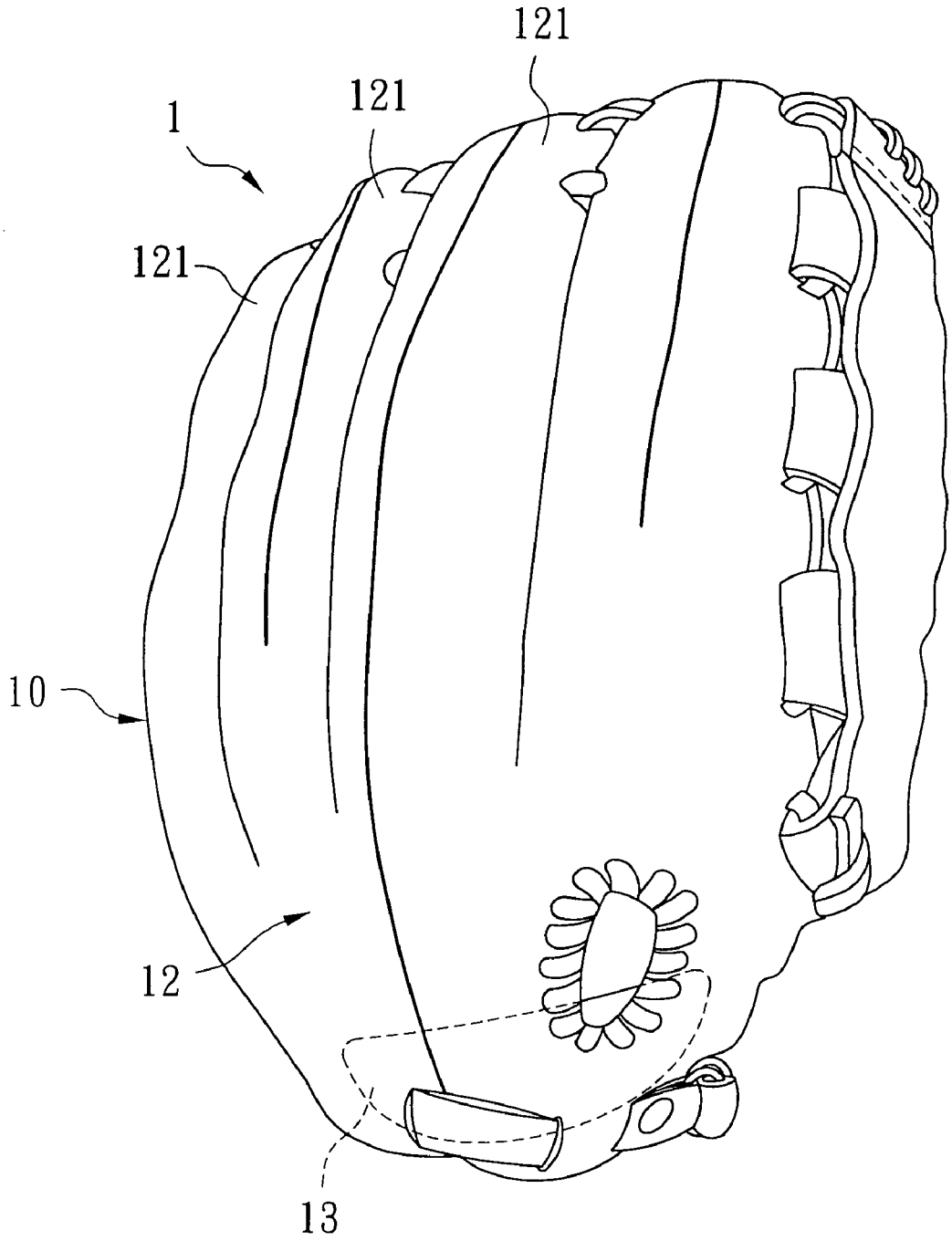
FIG. 2 PRIOR ART
FIG. 2 is a schematic rear view of the conventional baseball glove.

Before the present invention is described in greater detail, it should be noted that like elements are denoted by the same reference numerals throughout the disclosure.

Referring to FIGS. 3 to 7, the first preferred embodiment of a baseball glove 2 according to the present invention is shown to comprise a glove body 20 and a cushion sheet 22.

The glove body 20 is composed of a palm side ply 21, and a back side ply 23 connected to the palm side ply 21. The glove body 20 has an opening 230 that is adapted for insertion of a player's hand therein, and includes a palm section 24 substantially corresponding to a palm of a player's hand and having a thumb's ball area, and finger sections 25 extending upwardly from the palm section 24 and adapted for insertion of the player's fingers therein.

The palm side ply 21 of the glove body 20 has an inner face 212, and an outer face formed with a ball-catching region 211.

Figure 3:
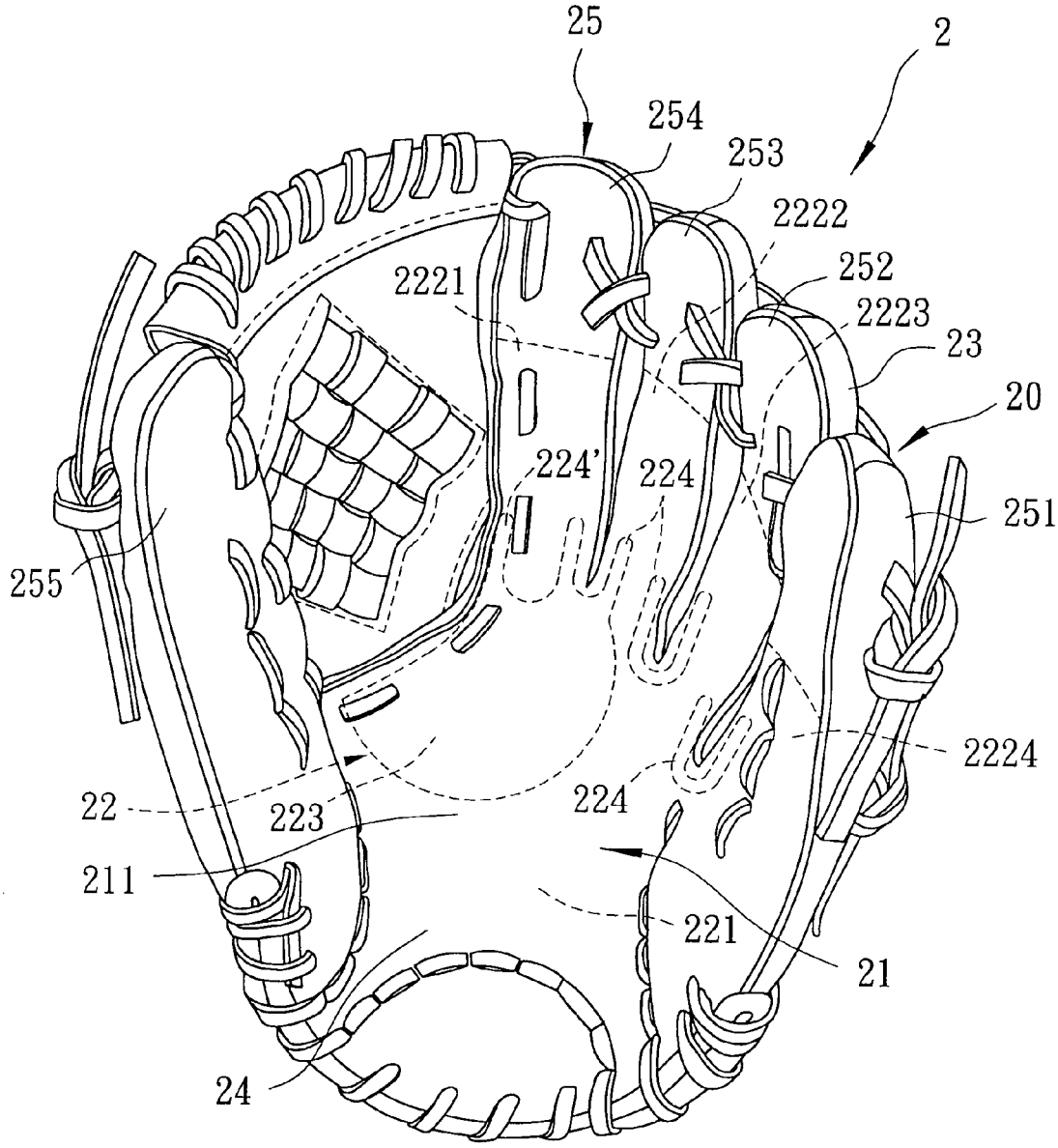
FIG. 3 is a schematic front view of the first preferred embodiment of a baseball glove according to the present invention.
Figure 4:
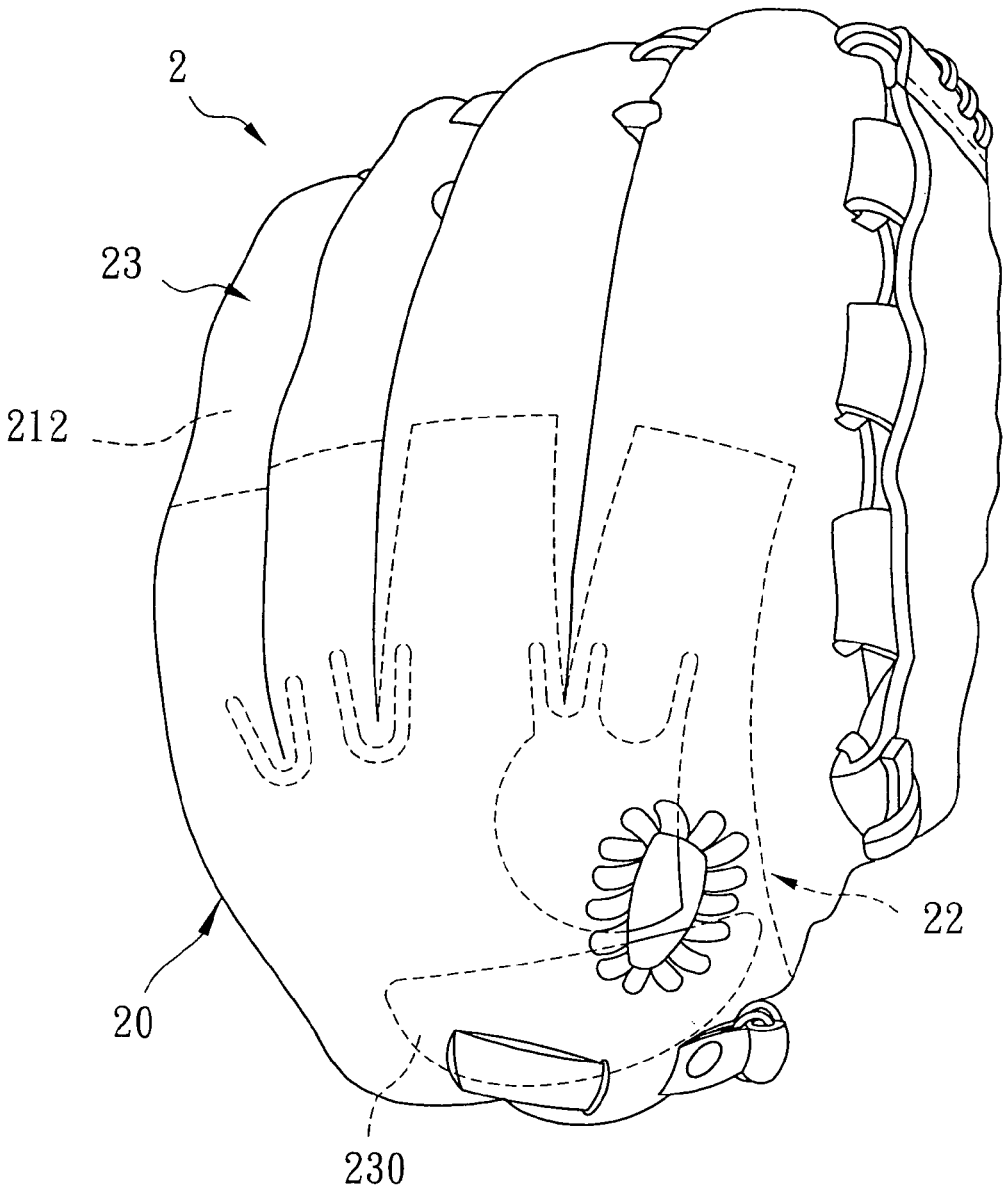
FIG. 4 is a schematic rear view of the first preferred embodiment.
Figure 5:
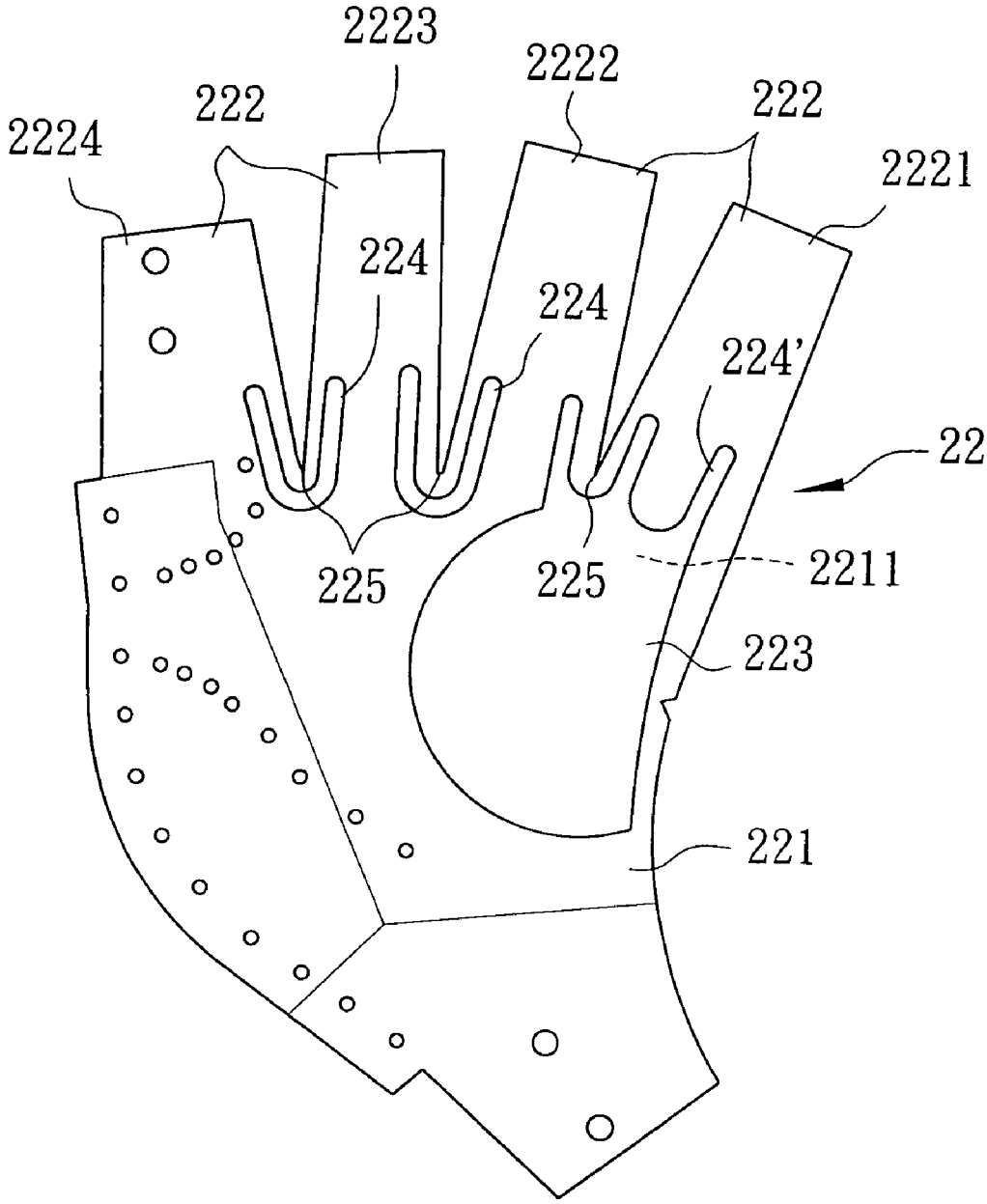
FIG. 5 is a schematic view of a cushion sheet of the first preferred embodiment.
Figure 6:
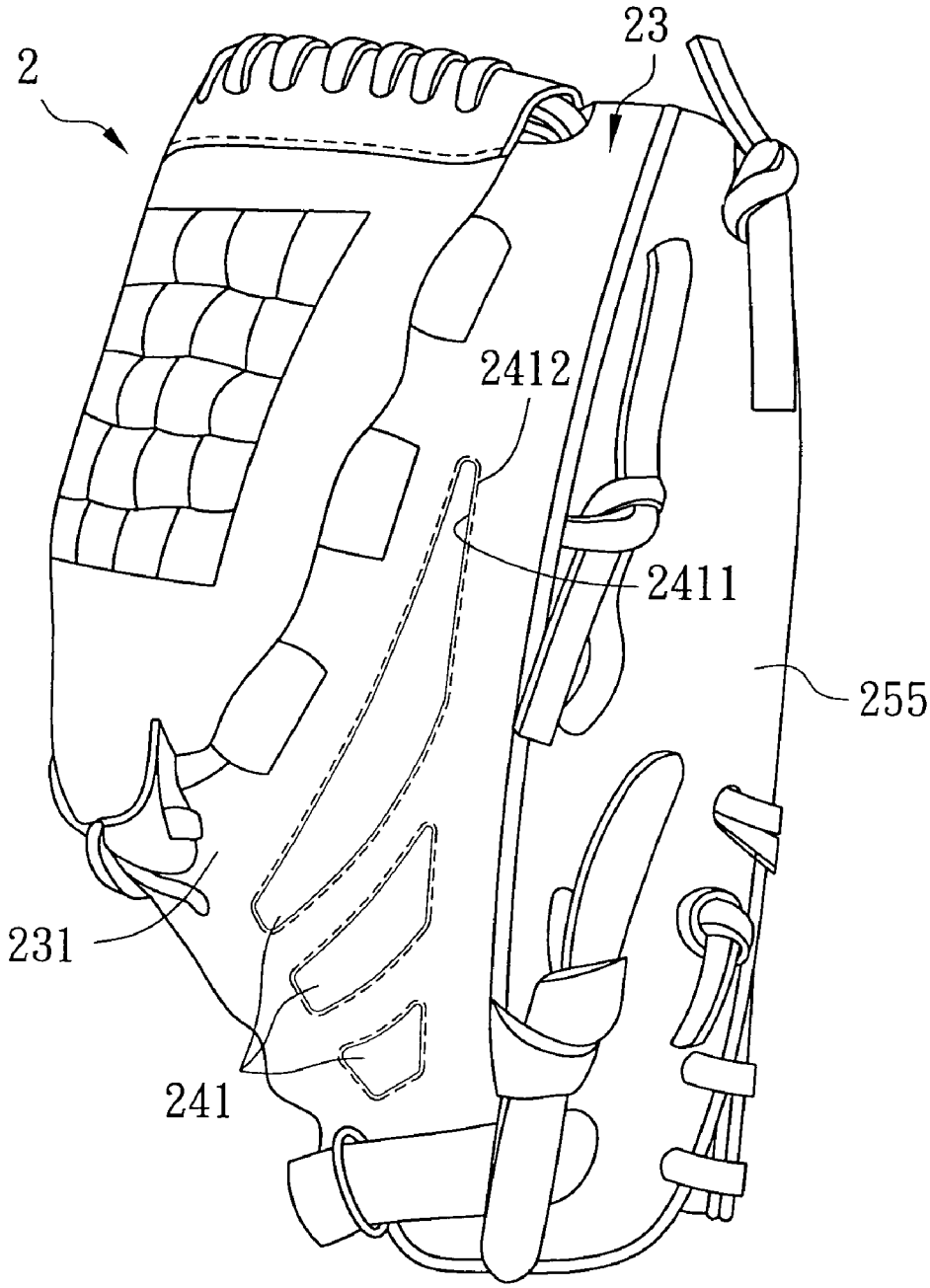
FIG. 6 is a schematic side view of the first preferred embodiment, illustrating a back side ply of the first preferred embodiment when provided with first back ribs.
Figure 7:
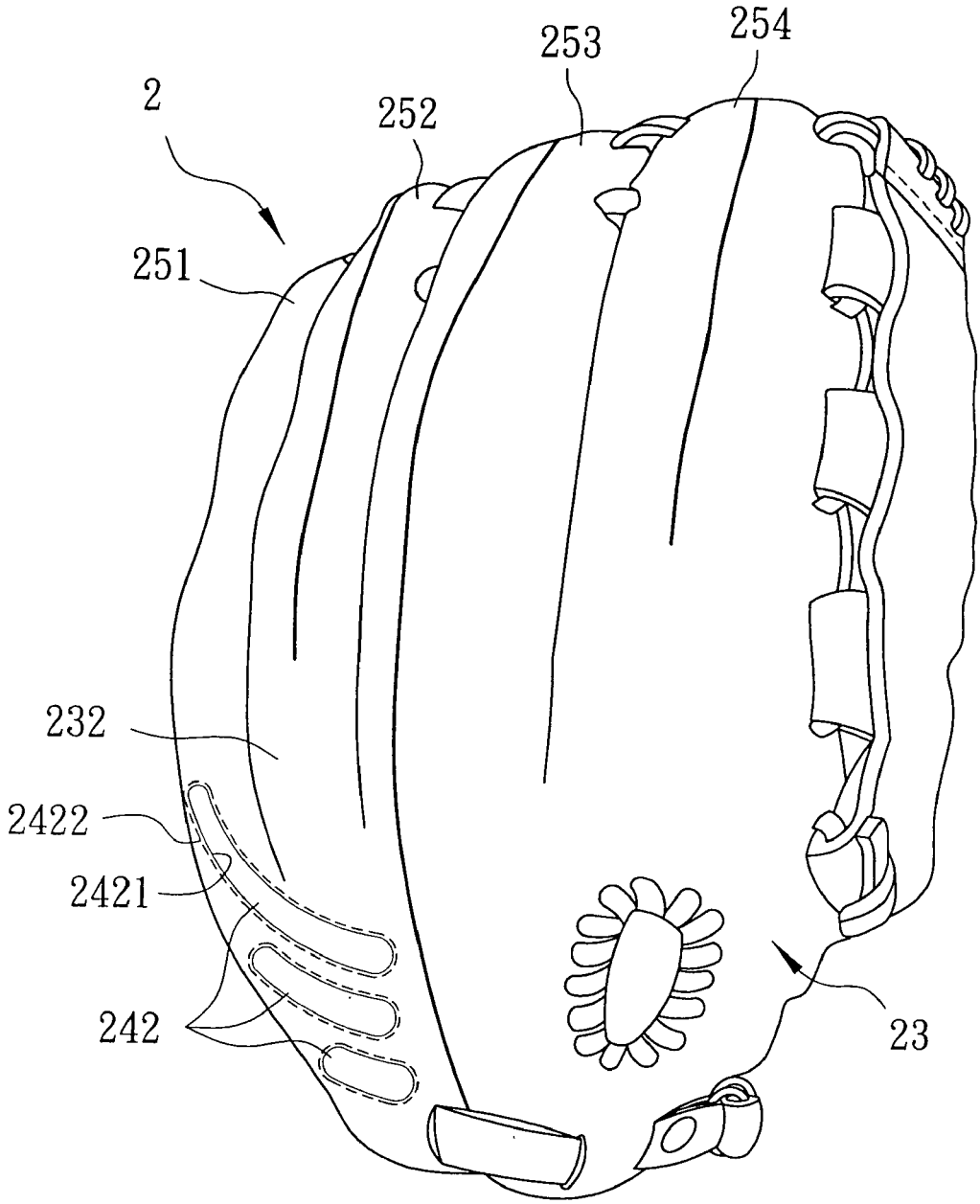
FIG. 7 is a view similar to FIG. 4, but illustrating the back side ply of the first preferred embodiment when provided with second back ribs.

The cushion sheet 22 is attached to the inner face 212 of the palm side ply 21. With reference to FIGS. 3 and 5, the cushion sheet 22 includes a palm portion 221, a plurality of finger portions 222, a plurality of webs 225, a hill portion 223, and a plurality of curved ribs 224. The palm portion 221 corresponds substantially to the palm section 24 of the glove body 20. The finger portions 222 extend outwardly from the palm portion 221, and include an index finger portion 2221, a middle finger portion 2222, a ring finger portion 2223, and a little finger portion 2224. The palm portion 221 has a pad area 2211 below the index finger portion 2221. Each of the webs 225 extends between two adjacent ones of the finger portions 222. The hill portion 223 projects from the palm portion 221, and covers the pad area 2211. Each of the curved ribs 224 has a substantially U shape, and is disposed along a respective one of the webs 225. The hill portion 223 and the curved ribs 224 have shock-absorbing foamed materials (not shown). In this embodiment, the hill portion 223 is connected integrally to one of the curved ribs 224 that extends along the web 225 between the index finger portion 2221 and the middle finger portion 2222. A single rib 224' projects upwardly to the index finger portion 2221 from the hill portion 223, and has shock-absorbing foamed material.

The cushion sheet 22 is made by first preparing a leather piece that has an outline similar to that of the cushion sheet 22, and a suitable amount of the shock-absorbing foamed material. The shock-absorbing foamed material and the leather piece are then placed in a mold, and are pressed together to form the cushion sheet 22. Afterwards, a fabric material is glued to the cushion sheet 22 to cover the shock-absorbing foamed materials, thereby fixing the shape of the hill portion 223, the curved ribs 224, and the rib 224', so that the hill portion 223 and the ribs 224, 224' will not be easily deformed.

The back side ply 23 of the glove body 20 faces the inner face 212 of the palm side ply 21 and the cushion sheet 22, and cooperates with the palm side ply 21 to form the finger sections 25, namely, a little finger section 251, a ring finger section 252, a middle finger section 253, an index finger section 254, and a thumb section 255. The back side ply 23 includes a first back surface region 231 on a back side of the thumb's ball area and having three spaced-apart first back ribs 241 (see FIG. 6). The back side ply 23 further includes a second back surface region 232 below the little and ring finger sections 251, 252 and having three spaced-apart second back ribs 242 (see FIG. 7). Each of the first and second back ribs 241, 242 is an elongated embossment protruding from the back side ply 23 and having a peripheral root 2411, 2421 that does not protrude from the back side ply 23. Each of the first and second back ribs 241, 242 is made by embossing a leather piece using a die, after which the peripheral root 2411, 2421 is sewn so as to form a stitching line 2412, 2422 that is looped along the peripheral root 2411, 2421 and to fix the shape of each back rib 241, 242. The stitching line 2412, 2422 of each back rib 241, 242 can prevent an external force from flattening the respective back rib 241, 242.

When the player's hand is inserted into the glove body 20 via the opening 230, the player's hand is in contact with the cushion sheet 22. Specifically, the player's palm abuts partially against the hill portion 223, and the anatomical webs between the player's index, middle, ring, and little fingers abut correspondingly against the curved ribs 224. The player's index finger further abuts against the rib 224'. As such, the player's palm, and index, middle, ring, and little fingers are protected by the hill portion 223 and the ribs 224, 224'. Hence, when the player catches a high speed ball either thrown by a teammate or batted by a batter, an impact force on the player's hand is buffered through the hill portion 223 and the ribs 224, 224' of the cushion sheet 22 so that injury to the player's hand can be avoided.

Further, through the hill portion 223 and the ribs 224, 224' of the cushion sheet 22, the index, middle, ring, and little fingers of the player can rest comfortably in the respective finger portions 254, 253, 252, 251 without experiencing any slipping.

Moreover, through the presence of the first and second back ribs 241, 242 on the back side ply 23 of the glove body 20, i.e., the first back ribs 241 projecting outwardly from the first back surface region 231 and the second back ribs 242 projecting outwardly from the second back surface region 232, the back side ply 23 of the glove body 20 is strengthened and protected. Further, an appearance of the glove body 2 is enhanced.

Figure 8:
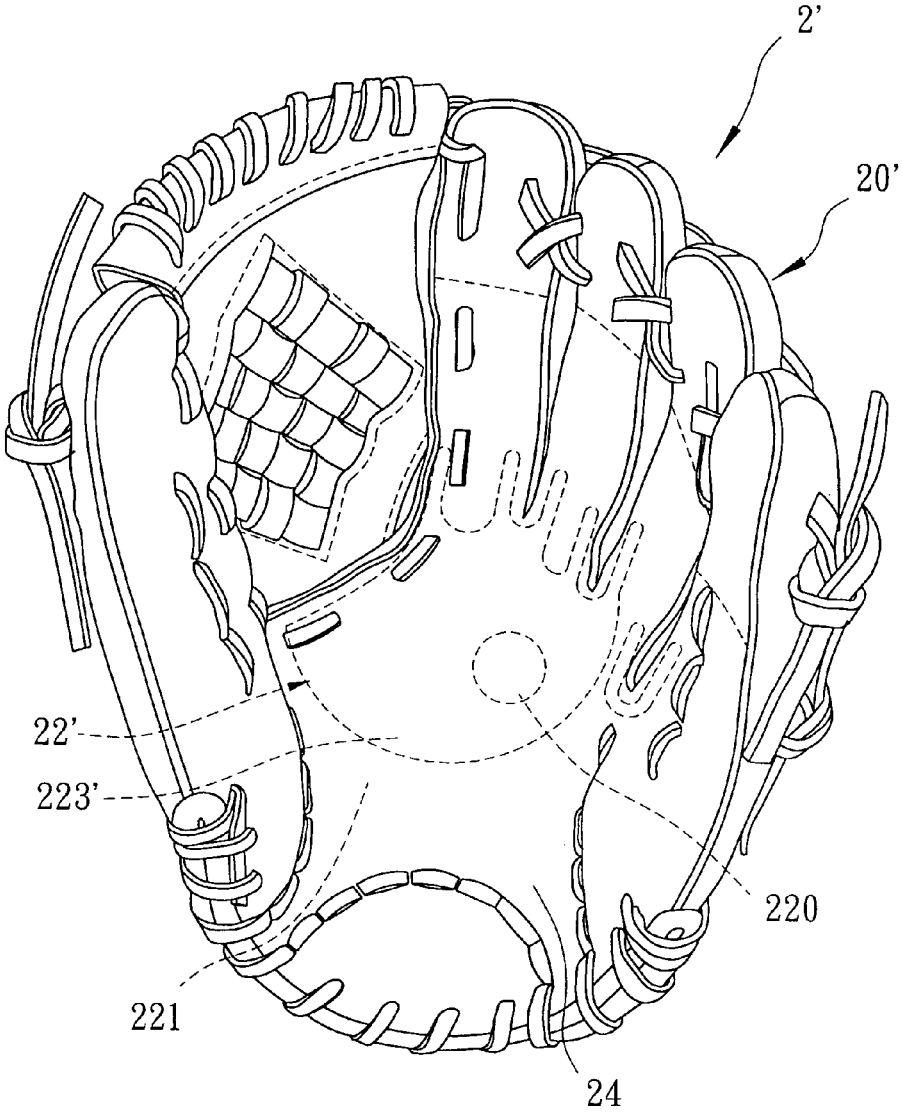
FIG. 8 is a schematic front view of the second preferred embodiment of a baseball glove according to the present invention.
Figure 9:
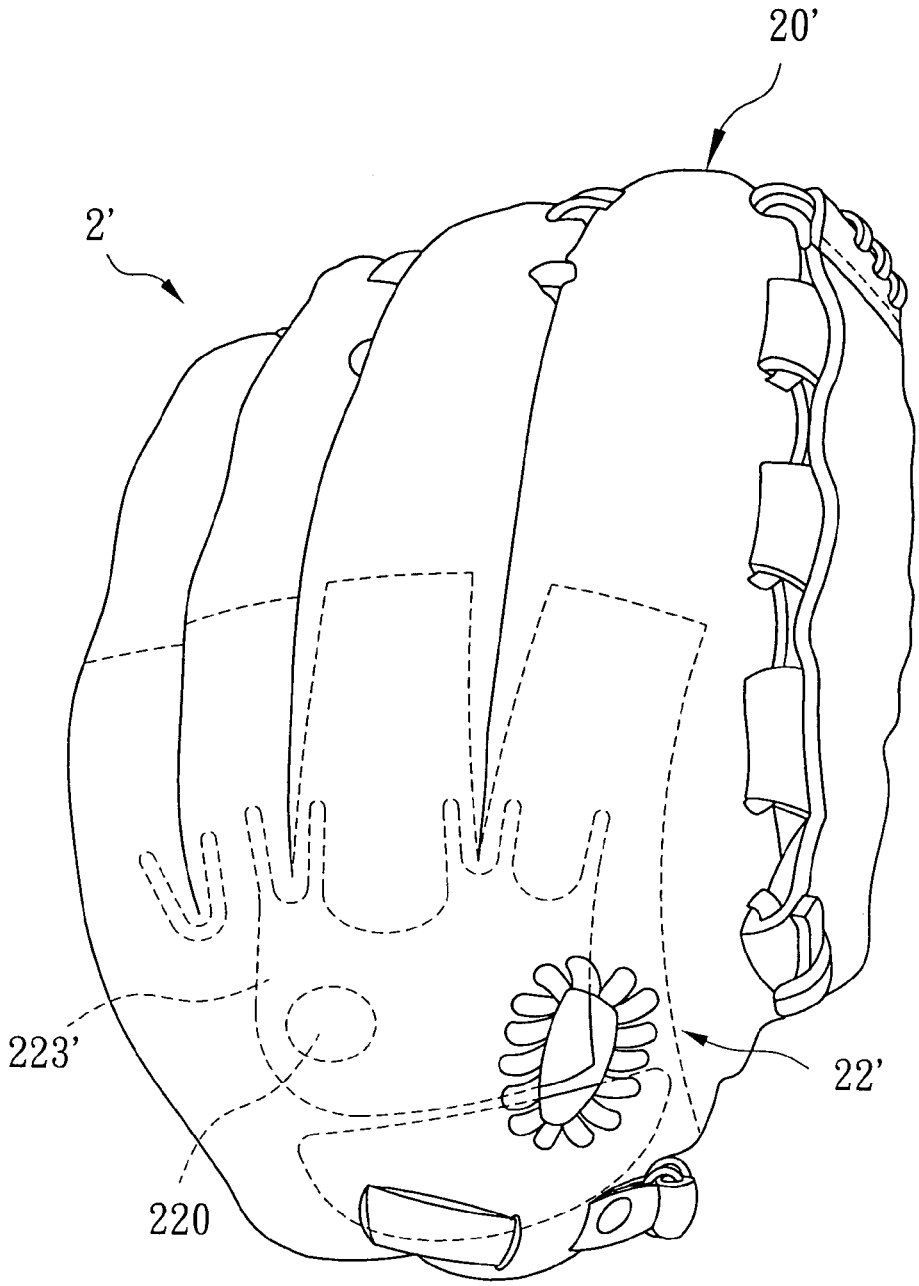
FIG. 9 is a schematic rear view of the second preferred embodiment.
Figure 10:
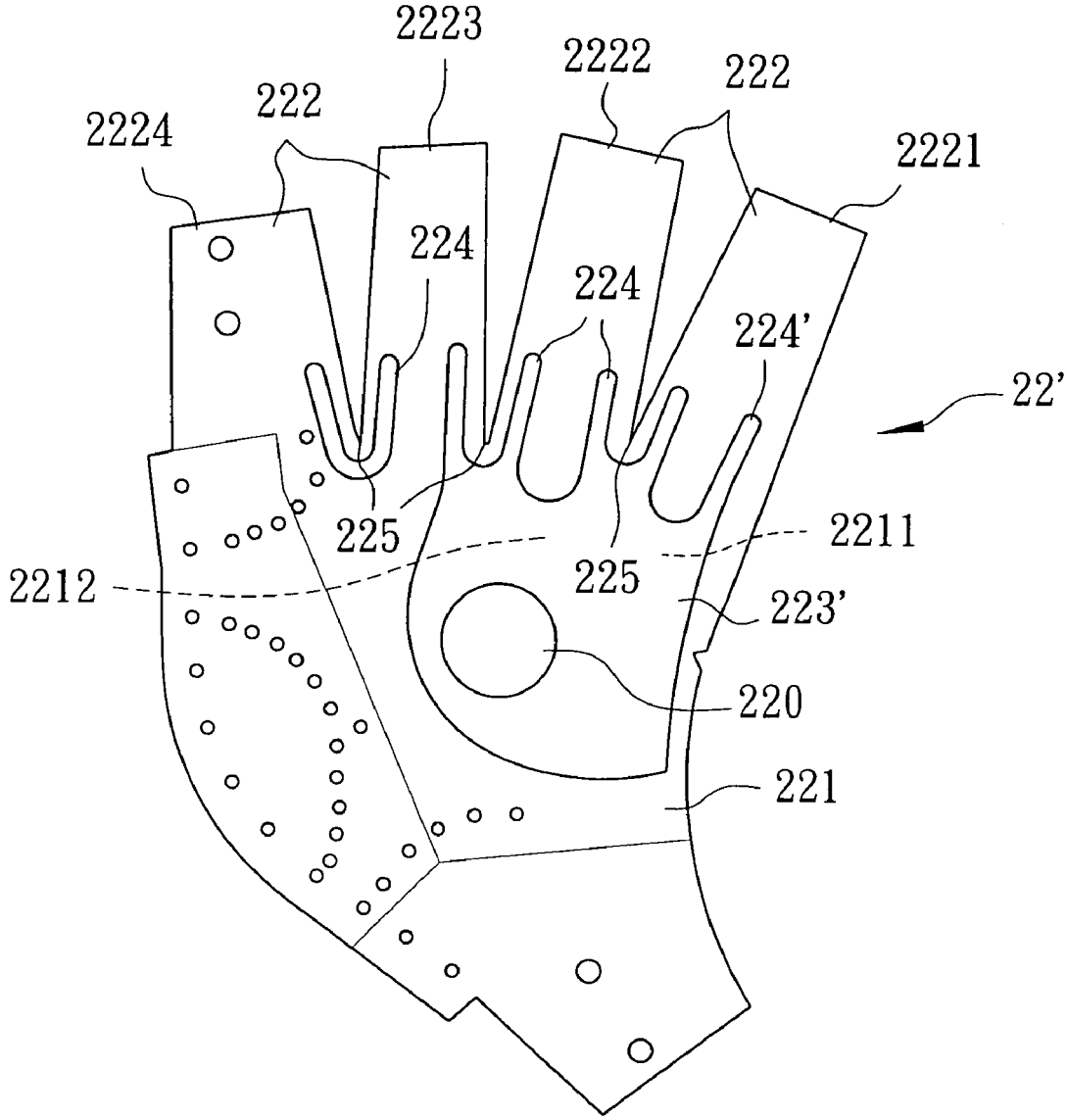
FIG. 10 is a schematic view of a cushion sheet of the second preferred embodiment.

Referring to FIGS. 8 to 10, the second preferred embodiment of a baseball glove 2' according to the present invention is shown to be similar to the first preferred embodiment. However, in this embodiment, the hill portion 223' of the cushion sheet 22' is provided with a buffering hollow part 220. The palm portion 221 further has a pad area 2212 below the middle finger portion 2222. The hill portion 223' covers additionally the pad area 2212, and is connected integrally to the curved rib 224 that extends along the web 225 between the middle finger portion 2222 and the ring finger portion 2223. The presence of the buffering hollow part 220 in the hill portion 223' is for achieving additional buffering effect on the palm section 24 of the glove body 20' during catching of a ball. The advantages of the first preferred embodiment can be achieved using the second preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A baseball glove comprising:

a glove body composed of a palm side ply that has an inner face, and a back side ply facing said inner face and connected to said palm side ply, said glove body including a palm section, and finger sections extending upwardly from said palm section; and a cushion sheet attached to said inner face of said palm side ply, and having a palm portion substantially corresponding to said palm section, a plurality of finger portions extending upwardly from said palm portion, a plurality of webs each extending between two adjacent ones of said finger portions, a hill portion projecting from said palm portion, and a plurality of U-shaped curved ribs extending laterally of said finger portions and said palm portion along said webs, each of said curved ribs having a substantially U shape and extending from one of said two adjacent ones of said finger portions toward said palm portion and then curving upwardly from said palm portion toward the other one of said two adjacent ones of said finger portions, said hill portion and said curved ribs having shock-absorbing foamed materials.

2. The baseball glove of claim 1, wherein said hill portion is provided with a buffering hollow part formed therein.

3. The baseball glove of claim 1, wherein said finger portions include an index finger portion, a middle finger portion, a ring finger portion, and a little finger portion.

4. The baseball glove of claim 3, wherein said palm portion has a pad area below said index finger portion, said hill portion covering said pad area and being connected to one of said curved ribs that extends along one of said webs which extends between said index finger portion and said middle finger portion.

5. The baseball glove of claim 4, wherein said palm portion further has a pad area below said middle finger portion, said hill portion covering additionally said pad area below said middle finger portion and being connected additionally to one of said curved ribs that extends along one of said webs which extends between said middle finger portion and said ring finger portion.

6. The baseball glove of claim 1, wherein said palm section has a thumb's ball area, said back side ply including a first back surface region on a back side of said thumb's ball area, said first back surface region having at least one first back rib.

7. The baseball glove of claim 6, wherein said finger sections include a little finger section and a ring finger section, said back side ply further having a second back surface region below said little finger and ring finger sections, said second back surface region having a second back rib.

* * * * *